US008286830B2

(12) United States Patent
Hygema

(10) Patent No.: US 8,286,830 B2
(45) **Date of Patent: *Oct. 16, 2012**

(54) LOCKING AEROSOL DISPENSER

(75) Inventor: Terry L. Hygema, Greer, SC (US)

(73) Assignee: Precision Valve Corporation, Yonkers, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/168,658

(22) Filed: Jun. 24, 2011

(65) Prior Publication Data

US 2011/0253749 A1 Oct. 20, 2011

Related U.S. Application Data

(62) Division of application No. 12/712,353, filed on Feb. 25, 2010, now Pat. No. 7,984,827, which is a division of application No. 11/649,625, filed on Jan. 4, 2007, now Pat. No. 7,699,190.

(51) Int. Cl.
*B67D 1/00* (2006.01)
*B67B 1/00* (2006.01)
*B65D 83/00* (2006.01)

(52) U.S. Cl. ..... 222/39; 222/153.11; 222/402.11

(58) Field of Classification Search ..... 222/39, 222/153.09, 153.11, 153.13, 153.14, 402.1, 222/402.11, 402.13
See application file for complete search history.

(56) References Cited

U.S. PATENT DOCUMENTS

| | | | | |
|---|---|---|---|---|
| 3,426,948 | A * | 2/1969 | Stirling | 222/402.11 |
| 3,601,290 | A | 8/1971 | Nigro | |
| 3,768,707 | A * | 10/1973 | Nigro | 222/402.13 |
| 4,132,333 | A * | 1/1979 | Debard | 222/402.13 |
| 4,187,963 | A * | 2/1980 | Mascia | 222/402.13 |
| 5,158,206 | A | 10/1992 | Kobayashi et al. | 222/39 |
| 5,203,841 | A * | 4/1993 | Kitabayashi | 222/402.11 |
| 5,244,128 | A | 9/1993 | De Laforcade | |
| 7,487,891 | B2 | 2/2009 | Yerby et al. | 222/153.13 |
| 7,984,827 | B2 * | 7/2011 | Hygema | 222/39 |
| 2003/0209569 | A1 * | 11/2003 | Jackson et al. | 222/402.11 |
| 2004/0112924 | A1 * | 6/2004 | Albisetti | 222/402.13 |
| 2005/0017027 | A1 | 1/2005 | Yerby et al. | 222/402.13 |
| 2005/0133542 | A1 * | 6/2005 | Kolanus | 222/402.13 |
| 2005/0184093 | A1 | 8/2005 | Brunerie et al. | 222/153.11 |
| 2007/0039979 | A1 | 2/2007 | Strand et al. | 222/402.11 |

FOREIGN PATENT DOCUMENTS

JP 05285428 A 11/1993

* cited by examiner

*Primary Examiner* — Kevin P Shaver
*Assistant Examiner* — Patrick M Buechner
(74) *Attorney, Agent, or Firm* — Ohlandt, Greeley, Ruggiero & Perle

(57) ABSTRACT

An aerosol valve actuator with a top portion rotatable on a bottom portion. The entire top portion in one rotatable position is depressible vertically to actuate the valve. A click post and clicking rib provide a single click in each direction of rotation. Flanges on top and bottom portions interact to stop rotation as soon as each click occurs. Plastic springs interact with spring biasing members only when the top portion is in actuating position, and assure return of the actuator top portion to full upward position for rotation after actuation of even a short-stemmed valve. Downwardly extending flexible connecting flanges connect the actuator top and bottom portions. The top portion has a lower periphery with a plurality of upwardly extending indentations to overlie lateral ribs in the lower portion in actuation position. The top and bottom portions have interfitting cylinders to stabilize the top portion and maintain verticality.

11 Claims, 8 Drawing Sheets

LOCKING AEROSOL DISPENSER

CROSS REFERENCE TO RELATED APPLICATIONS

This application is a divisional of U.S. application Ser. No. 12/712,353 filed on Feb. 25, 2010, now U.S. Pat. No. 7,984,827 issued on Jul. 26, 2011, which is a divisional of Ser. No. 11/649,625, filed Jan. 4, 2007, now U.S. Pat. No. 7,699,190 issued on Apr. 20, 2010, the entire contents of both of which are incorporated herein by reference.

BACKGROUND OF THE INVENTION

1. Field of the Invention

The present invention relates to plastic aerosol dispensers of the type often referred to as spray dome dispensers or actuators. More particularly, the present invention relates to such a dispenser having a top portion mounted on and rotatable with respect to a bottom portion between a first operative position for aerosol valve actuation and a second inoperative position in which the aerosol valve cannot be actuated.

2. Description of Related Art

Prior art locking aerosol dispensers have existed for years and have had many different structural designs of interrelating parts. Some of these designs are overly complex to mold, while others require more force than desirable for the user to operate between the inoperative and operative positions.

Still other designs in the unlocked position may not, following valve actuation, adequately return the top portion of the actuator upwardly to its rotatable position when used with aerosol valves having shorter stem heights due to normal variations in stem heights, etc. Such designs when used with shorter stem heights may also result in rattling between the top and bottom actuator portions to imply a flimsiness to the consumer.

Additional designs are not sufficiently robust and are vulnerable to damage to their parts and operation due to excessive top loads from misuse, handling, shipping, etc.

Locking actuators also often incorporate clicking mechanisms of various forms to advise the consumer regarding whether the actuator has been rotated to its locked or unlocked position. Such mechanisms, however, are often overly complex and may provide multiple clicks with multiple clicking mechanisms when rotating between such positions, so that the consumer may be confused as to the status and operation of the actuator. Such mechanisms may also involve a considerable angular rotation of the actuator parts, which may further confuse the consumer.

SUMMARY OF THE INVENTION

The present invention is intended to provide an aerosol valve actuator having a top and a bottom portion, the top portion being rotatable with respect to the bottom portion between a first position for actuating the aerosol valve and a second position where the aerosol valve cannot be actuated. The aerosol valve is actuated by depressing the entire top portion as a unit in a vertical direction with respect to the bottom portion. A click post and a flexible clicking rib provide a single click in each direction of rotation of the top portion, so as to indicate the actuator rotational position in a non-confusing manner to consumers who might otherwise be confused by multiple clicks in each direction of rotation. The clicking post has a configuration and alignment to cause the clicking rib to pass on opposite sides of the clicking post for opposite directions of rotation and to provide a pronounced clicking sound.

Further, stop flanges on the bottom portion of the actuator, and support flanges for connecting flanges on the top portion of the actuator, interact to stop rotation of the top portion of the actuator in each of its rotational directions as soon as the single click in that direction has occurred. This also helps to avoid consumer confusion, and assures alignment of the top and bottom portions for dispensing.

Additionally, the lower portion of the actuator has a plurality of plastic spring members that interact with a plurality of spring-biasing members extending from the upper portion of the actuator only when the top portion has been rotated to its first position. In that position, the spring-biasing members overlie, contact and slightly depress the plastic spring members in a non-actuating manner to prevent rattling between the top and bottom portions of the actuator, and to assure even in the presence of an aerosol valve with short stem height that the actuator top portion will be returned to its full upward position following product dispensing so that the top portion can then be rotated to the non-dispensing position.

The top portion of the actuator has a plurality of downwardly extending flexible connecting flanges to snap under structure of the bottom portion of the actuator. These connecting flanges are attached to the upper portion of the actuator by a plurality of supporting flanges, a supporting flange of each connecting flange serving as an aforementioned stop member assisting in terminating the rotation of the top portion. The top portion of the actuator also has a lower periphery with a plurality of upwardly extending indentations therein that overlie a plurality of lateral ribs in the lower actuator portion only when the top actuator portion is in its actuating position prior to dispensing. Depression of the top actuator portion then locates the indentations down onto the ribs to align the top and bottom actuator portions for dispensing. The top and bottom portions of the actuator also have interfitting cylinders to stabilize the top portion and maintain verticality.

Other features and advantages of the present invention will be apparent from the following description, drawings and claims.

DETAILED DESCRIPTION OF EMBODIMENTS

Figure 1:
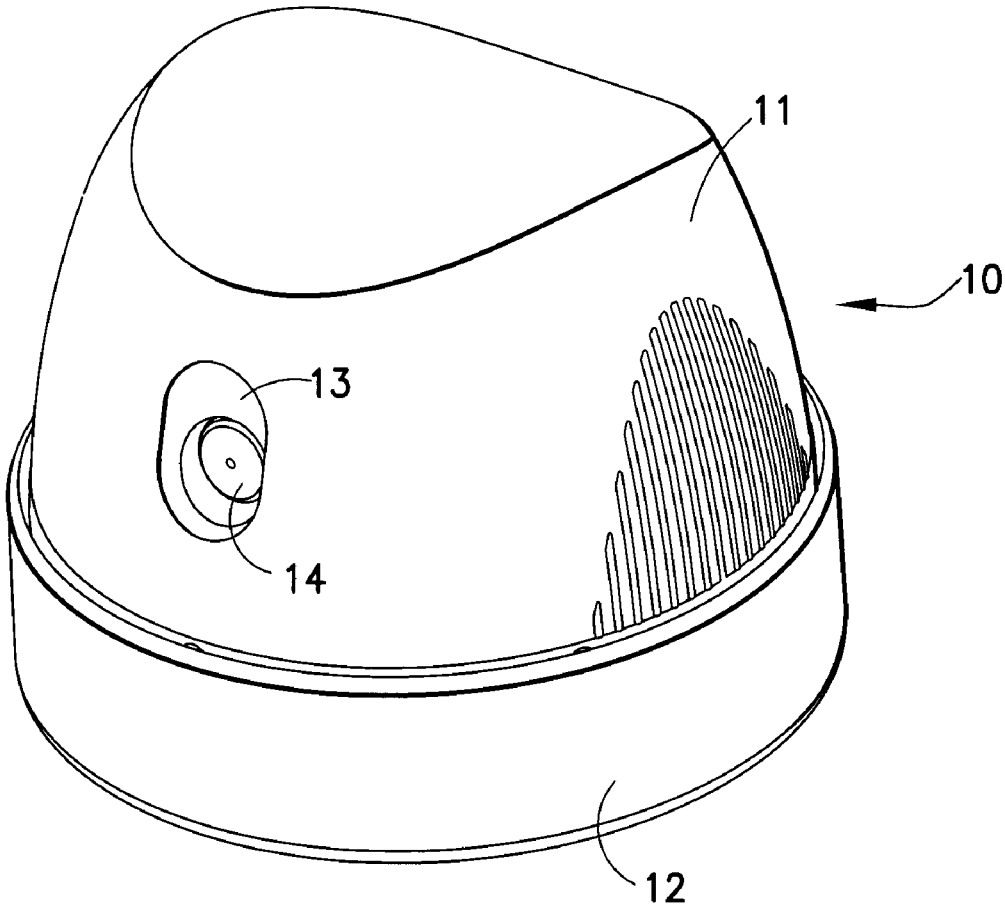
FIG. 1 is a perspective view of the locking aerosol dispenser of the present invention.

Referring to FIG. 1, aerosol dispenser 10 of the present invention is illustrated as assembled and in its unlocked actuating position. Actuator 10 has top portion 11 which is mounted on and rotatable with respect to bottom portion 12. Bottom portion 12 is mountable on top of an aerosol product container with an upstanding aerosol valve stem (not shown). Actuator top portion 11 has a front opening 13 which aligns with product nozzle 14 when the dispenser 10 is in its unlocked actuating position. The entire top portion 11 may be vertically depressed as a unit with respect to the bottom portion 12 to actuate the aerosol vertical valve stem and valve in the unlocked actuating position of dispenser 10. When the top portion 11 is rotated with respect to bottom portion 12 a small rotational distance away from the actuating position, top portion 11 can no longer be vertically depressed, and the aerosol valve stem and valve thus can no longer be actuated.

Figure 2:
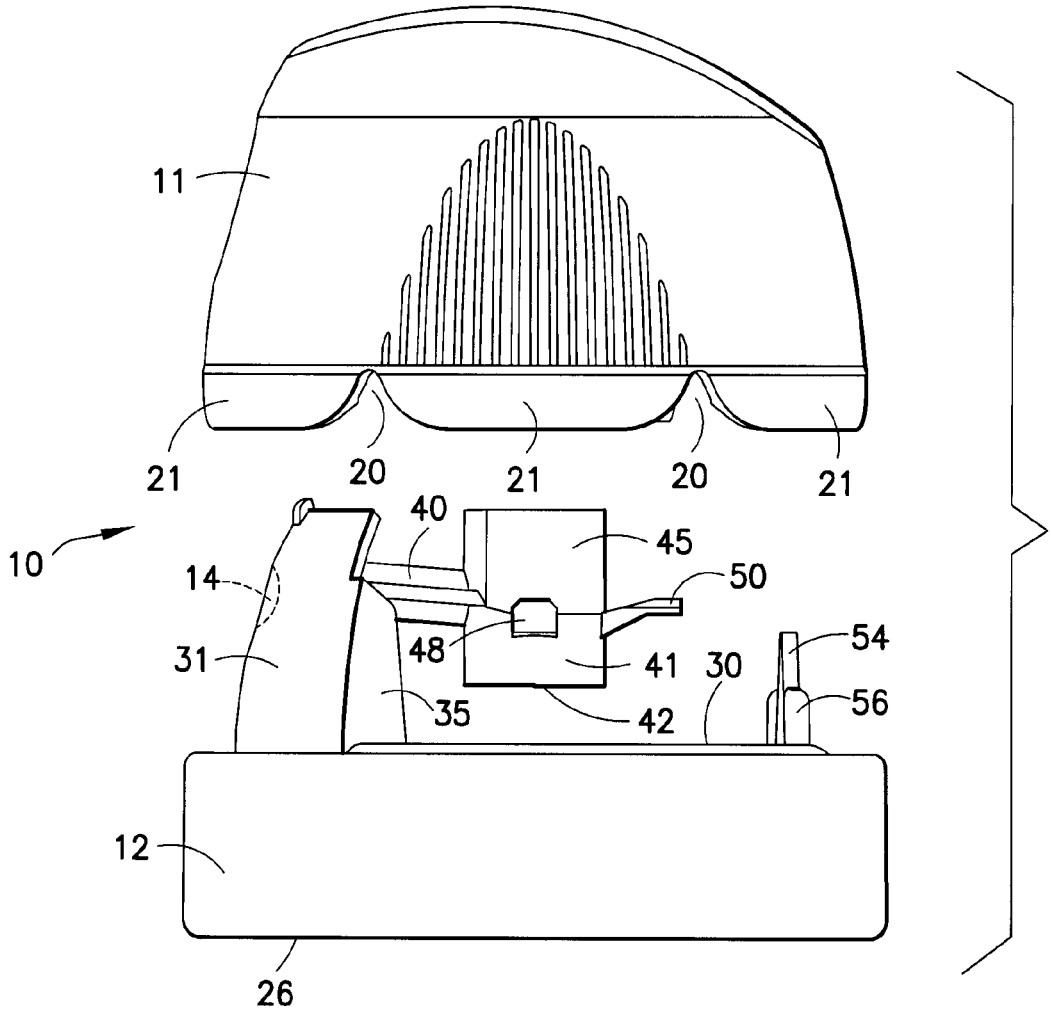
FIG. 2 is a side view of the disconnected top and bottom portions of the dispenser of FIG. 1.
Figure 3A:
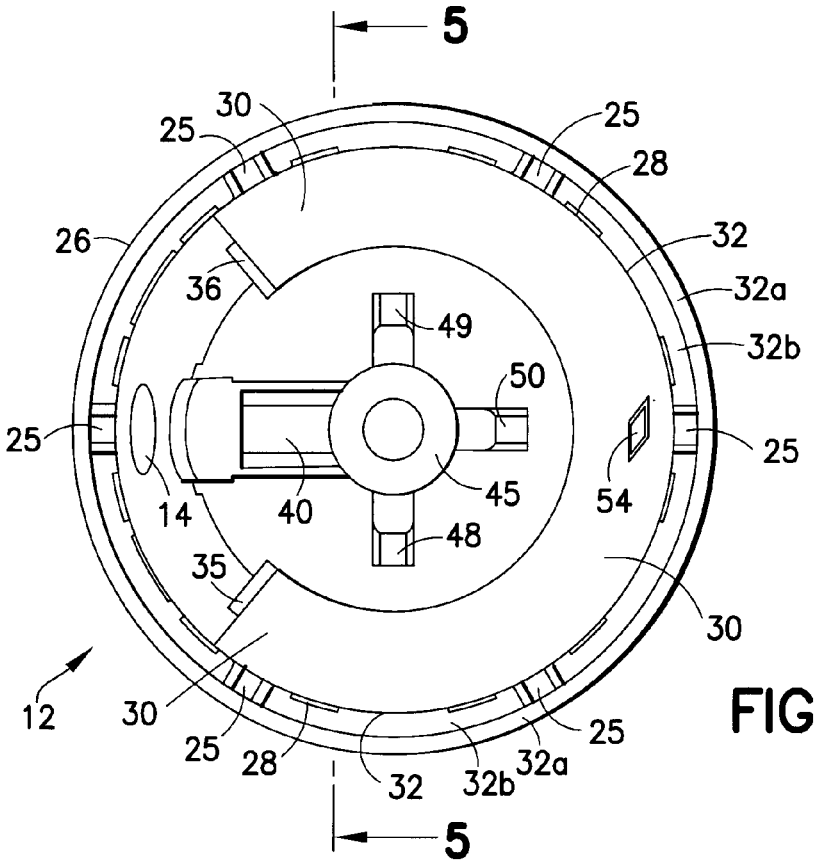
FIGS. 3A and 3B illustrate various aspects of the disconnected top and bottom portions of the dispenser of FIG. 1, FIG. 3A being an overhead view of the top of the bottom portion and FIG. 3B being an underneath view of the bottom of the top portion.
Figure 3B:
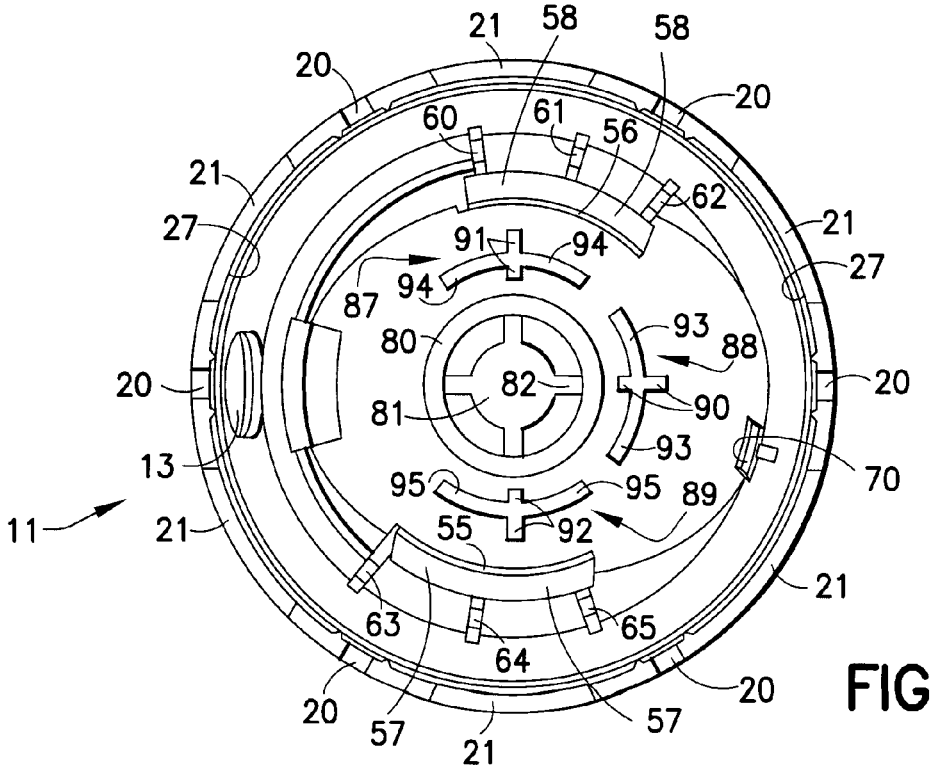

FIGS. 2, 3A and 3B show the actuator 10 of FIG. 1 with its top portion 11 and bottom portion 12 disconnected. FIG. 3B represents the top portion 11 having been disconnected without rotation from the bottom portion 12 and merely inverted. Front opening 13 of FIG. 3B and nozzle 14 of FIG. 3A accordingly continue to face in the same direction. Top actuator portion 11 has about its lower periphery a plurality of spaced curved indentations 20 which define peripheral segments 21 therebetween (see FIGS. 2 and 3B). Bottom actuator portion 12 (see FIG. 3A) in turn has a plurality of ribs 25 adjacent to, spaced about and extending inwardly from its bottom periphery 26. Merely as an example, FIGS. 3A and 3B show six such curved indentations 20, six such peripheral segments 21 and six such ribs 25. When dispensing actuator 10 is assembled and is in its actuating position, top portion 11 can be vertically depressed by the consumer's finger on its top, whereby curved indentations 20 move downwardly over and bottom on the ribs 25, and peripheral segments 21 lie between ribs 25. The curved portions of indentations 20 guide the ribs 25 and indentations 20 into full alignment with each other to establish the dispensing position, and the plurality of each stabilizes the top portion 11 and bottom portion 12 in the fully depressed position. In that position, the aerosol valve stem has been actuated to dispense product. When assembled dispensing actuator 10 is in its non-actuating position, peripheral segments 21 sit on top of ribs 25 and top portion 11 cannot be vertically depressed to actuate the aerosol valve.

Figure 5:
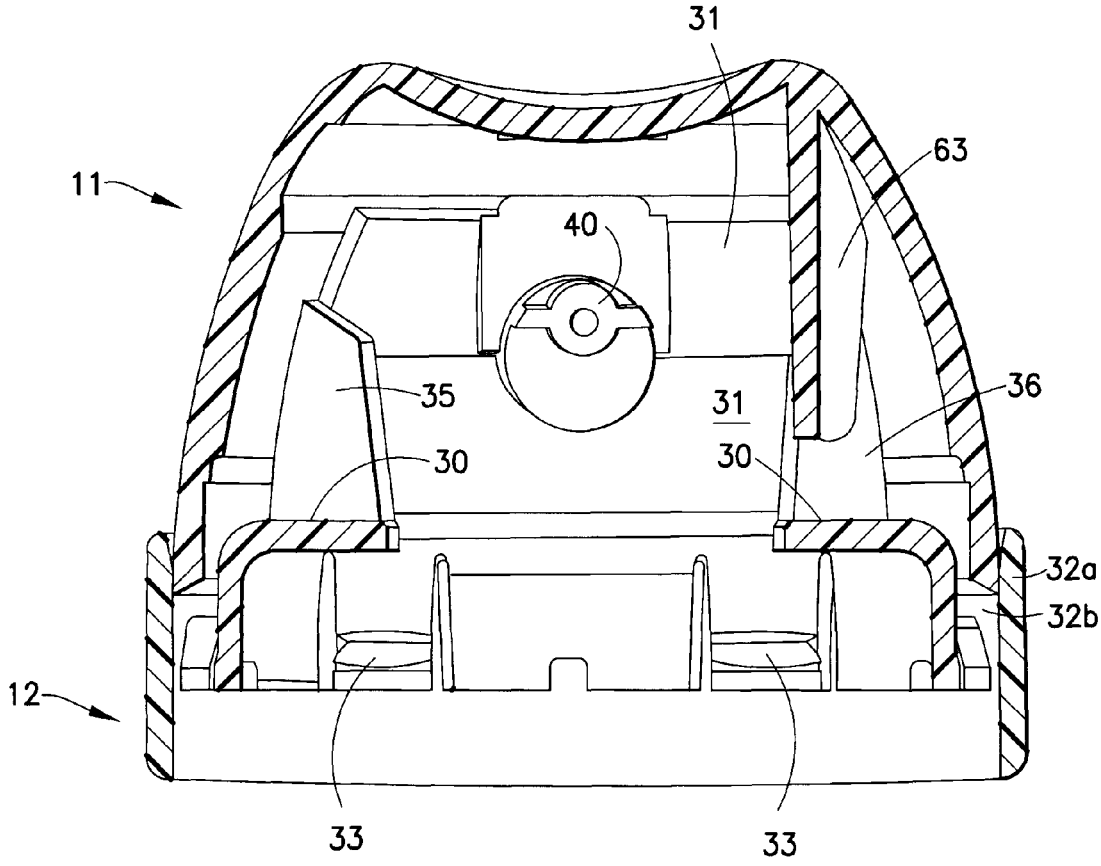
FIG. 5 is a cross-sectional view of the assembled dispenser of FIG. 1, taken along lines 5-5 of FIG. 3A and with the top and bottom portions of the dispenser assembled to each other and with the actuator in the unlocked actuating position.
Figure 6:
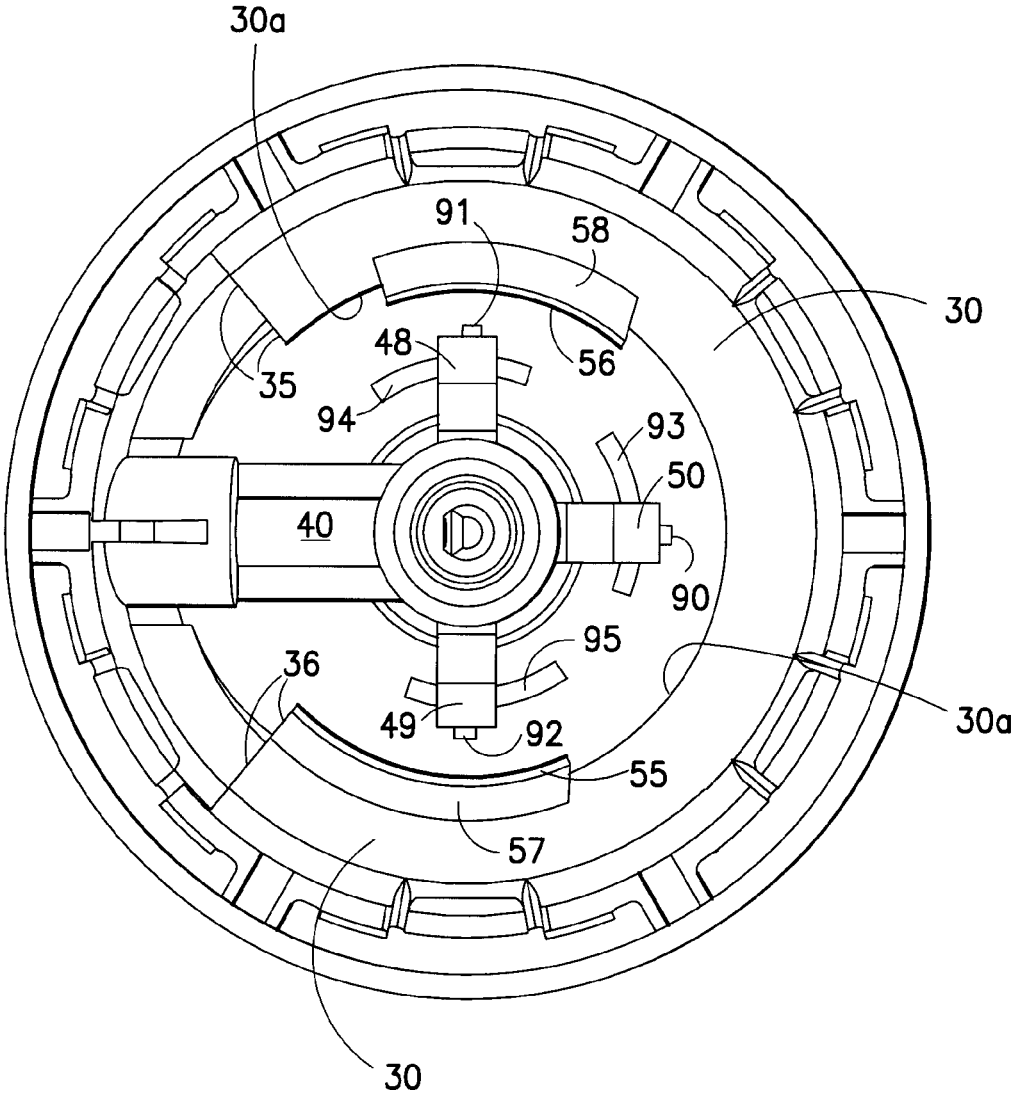
FIG. 6 is a bottom view of the assembled dispenser of FIG. 1 when the dispenser is in the unlocked actuating position.
Figure 7:
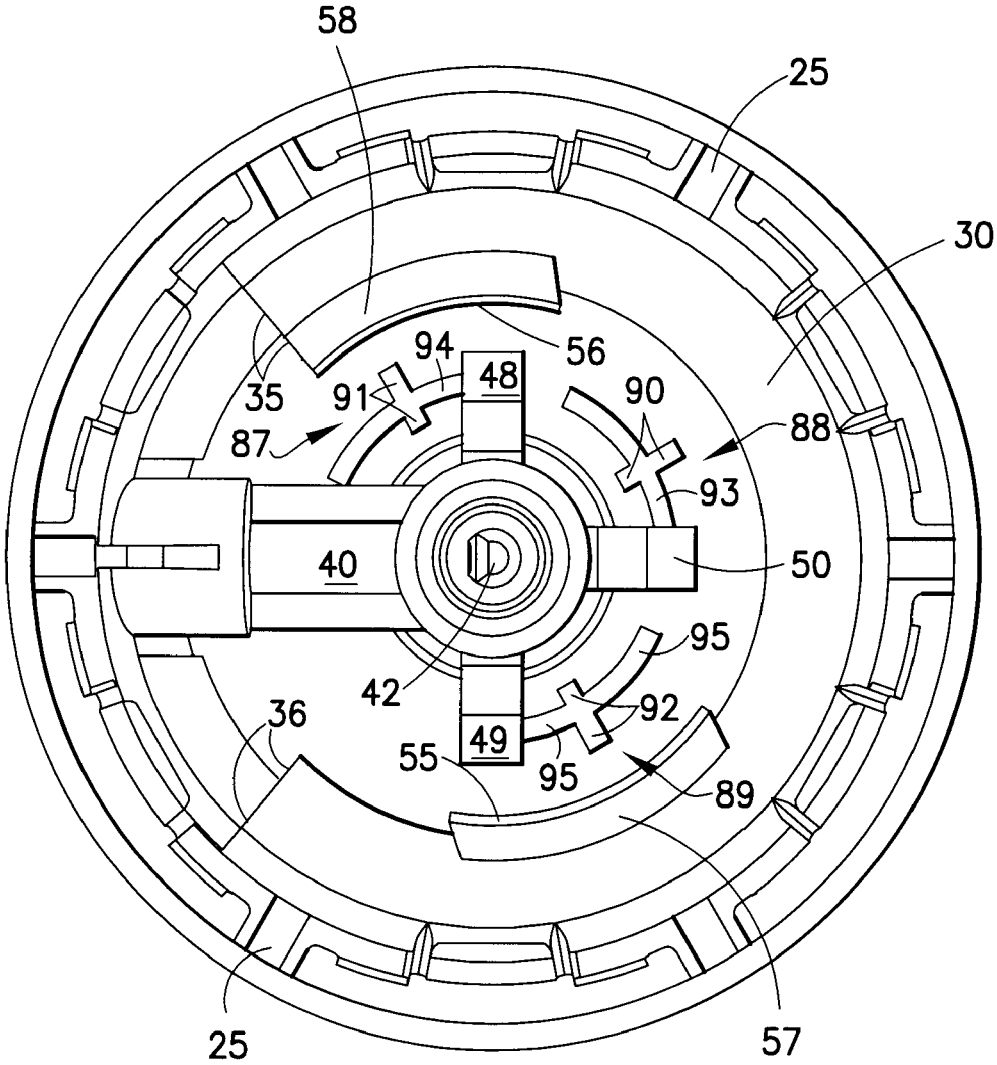
FIG. 7 is a bottom view of the assembled dispenser of FIG. 1 when the dispenser is in the locked non-actuating position.

Referring to FIGS. 2 and 3A, bottom actuator portion 12 has internal partial ring member 30 and upstanding curvilinear face plate 31 from which nozzle 14 opens forwardly from. Integral to the opposite circumferential ends of face plate 31 are vertically and radially inwardly extending wing flanges 35 and 36 (also see FIG. 5) which are identical to each other. Wing flanges 35 and 36 serve as stops to the rotation of actuator top portion 11 about actuator bottom portion 12 in a manner described below. Also integrally mounted upon face plate 31 and rearwardly extending therefrom is roughly horizontal flexible product channel 40, from the opposite end of which depends vertical product channel 41 having a conventional socket 42 at its base for insertion of the aerosol valve stem when lower actuator portion 12 is mounted on the aerosol container. Upwardly extending but closed off from vertical product channel 41 is cylinder 45, which when actuated downwardly by upper actuator portion 11 in the actuating position will flex horizontal and vertical product channels 40 and 41 downward to actuate the aerosol valve and dispense product out through nozzle 14.

Referring to FIGS. 2 and 3A, extending from opposite sides and rearwardly of vertical product channel 41 are flexible plastic spring members 48, 49 and 50. The function of these spring members is described further below and is to assure that upper actuator portion 11 returns to its full upper portion when the actuating user ceases to depress the upper portion 11 for dispensing, even in the presence of a short aerosol valve stem.

Figure 4:
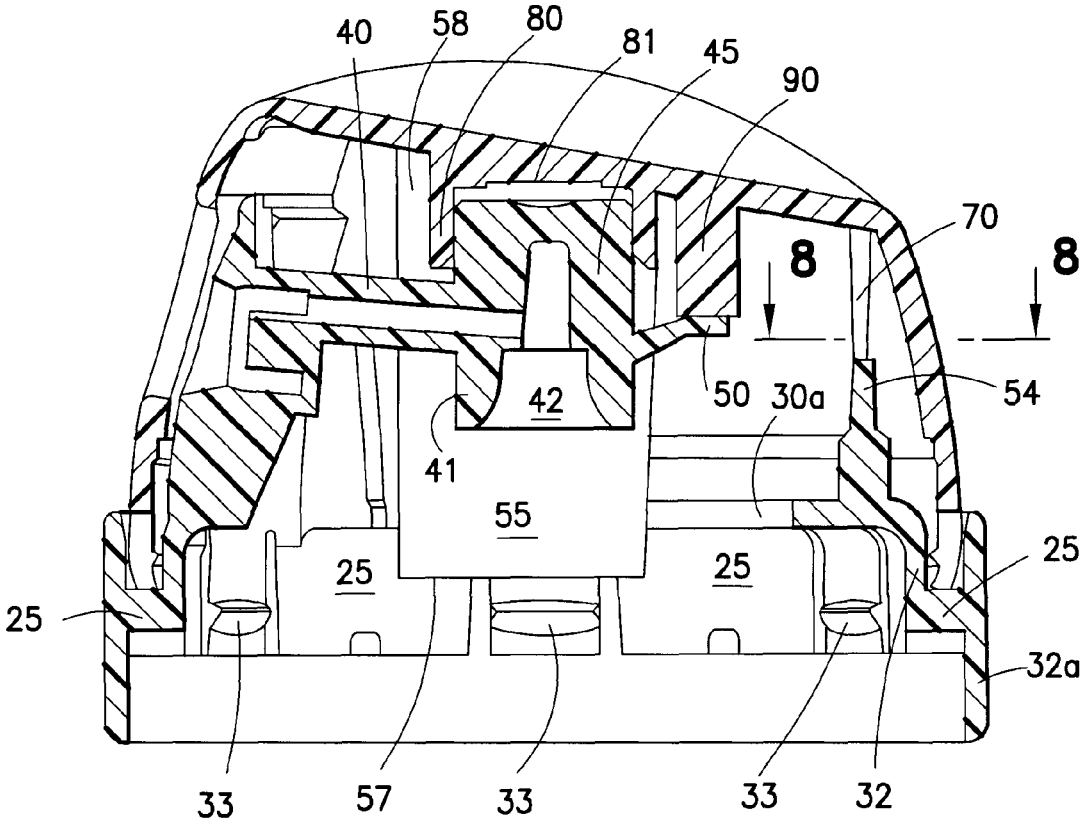
FIG. 4 is a cross-sectional view of the assembled dispenser of FIG. 1, taken front to back along a vertical plane passing through the vertical central axis of the dispenser and showing the actuator in the unlocked actuating position.

Still referring to FIGS. 2 and 3A, internal partial ring member 30 of actuator lower portion 12 has an upstanding clicking post 54 opposite nozzle 14. Clicking post 54 interacts in a particular manner with a clicking rib in actuator upper portion 11, as described below. Alternatively, the clicking post may be in the upper portion and the clicking rib may be in the lower portion. Clicking post 54 may be a parallelogram of the shape shown in FIGS. 3A and 8, and may have a thickened base 56 as shown in FIG. 2 to lend rigidity to the clicking post. Clicking post 54 may have other shapes, including, for example, an ellipse. Referring to FIGS. 3A and 4, partial ring member 30 also has skirt 32 extending downwardly from its outer periphery, and ribs 25 referenced above extend between said skirt 32 and adjacent the bottom periphery 26 of the outer skirt 32*a* of lower actuator portion 12. The skirt 32 of the internal partial ring member 30 and the outer skirt 32*a* define an annular gap 32*b*. The bottom of skirt 32 has small flanges 33 projecting inwardly therefrom, which flanges serve to lock under the outer edge of the aerosol valve mounting cup (not shown) mounted on the aerosol product container. In this manner, the actuator lower member 12 is mounted to the aerosol container.

Having above described the structural details of actuator lower portion 12, FIGS. 3B, 4, 6 and 7 are now referenced regarding the internal structure of actuator upper portion 11. Extending downwardly from the top wall of actuator upper portion 11 are two diametrically opposite curvilinear connecting flanges 55 and 56 having flexible lower extremities for connecting actuator upper portion 11 to actuator lower portion 12. Connection flange 55 at its lower extremity has outwardly and upwardly directed rib 57, and connection flange 56 at its lower extremity has outwardly and upwardly directed rib 58. Ribs 57 and 58 snap under the inner edge 30*a* of ring member 30 when upper actuator portion 11 of the actuator is connected to lower actuator portion 12 to thereby lock the two actuator portions together. Downwardly extending connection flange 55 is also attached at its upper portion to the inner side wall of actuator portion 11 by supporting flanges 63, 64 and 65, and downwardly extending connection flange 56 is also attached at its upper portion to the inner side wall of actuator portion 11 by supporting flanges 60, 61 and 62.

Supporting flanges 63 and 60 also serve as stop members. Referring to FIGS. 2, 3B, 5, 6 and 7, when upper actuation portion 11 is rotated counterclockwise from the locked to the unlocked position with respect to lower portion 12, supporting flange/stop member 63 abuts against wing flange 36 of actuator bottom portion 12 to stop further counterclockwise rotation. When upper actuator portion 11 is rotated clockwise from the unlocked to the locked position with respect to lower portion 12, supporting flange/stop member 60 abuts against wing flange 35 of actuator bottom portion 12 to stop further clockwise rotation.

Peripheral segments 21 of top portion 11 may also have a plurality of slight inwardly extending spaced flanges 27 that snap over a plurality of slight outwardly extending flanges 28 of lower portion 12 when the top and bottom portions 11 and 12 are assembled, thereby assisting in providing a robust assembly.

Figure 8:
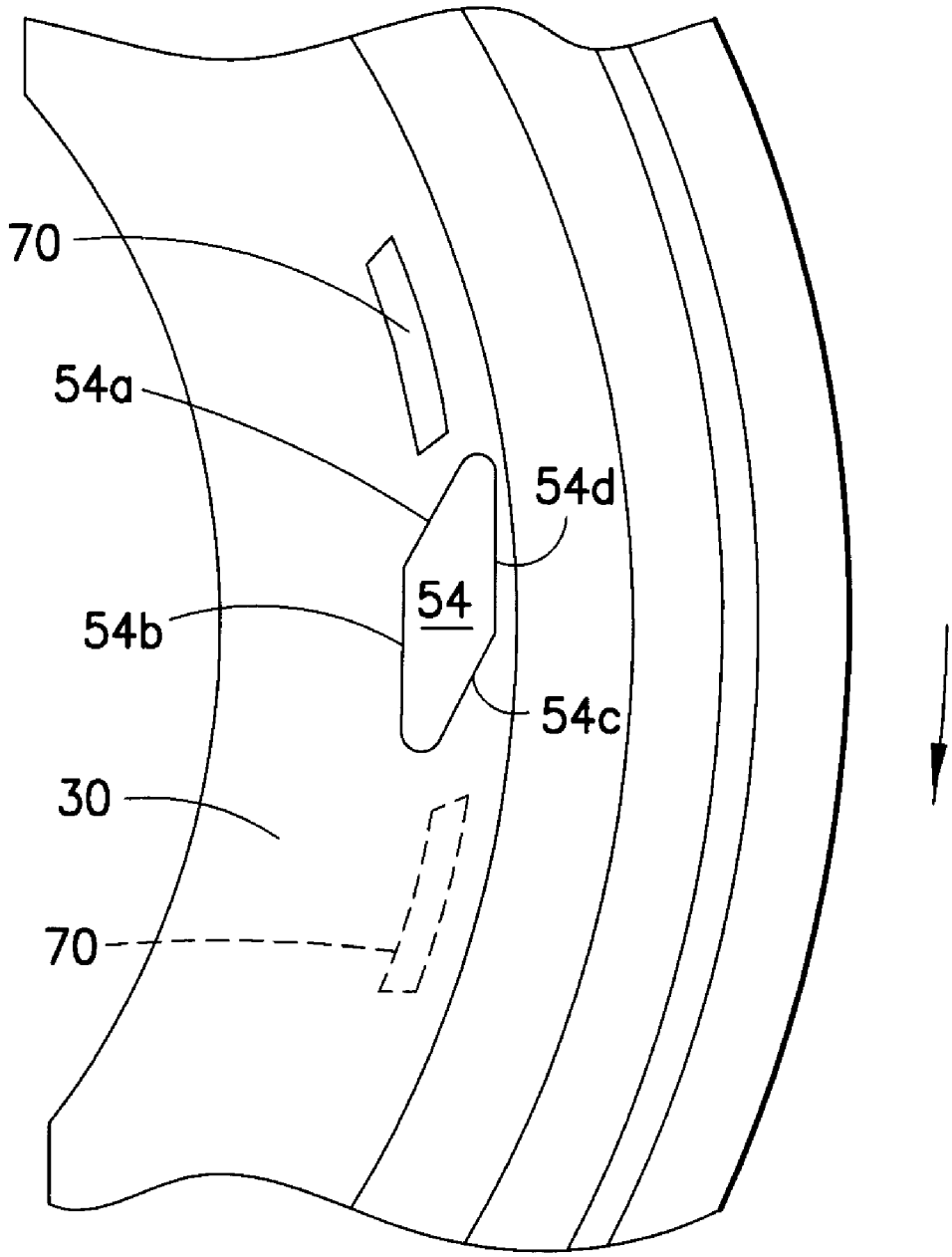
FIG. 8 is an enlarged fragmentary plan view of the clicking mechanism of the dispenser of FIG. 1, taken along lines 8-8 of FIG. 4.

Turning now to the single click function and structure of the present invention, FIG. 3B shows a flexible clicking rib 70 attached to and depending from the top wall of actuator portion 11. Clicking rib 70 interacts with flexible clicking post 54 (see FIGS. 2, 3A, 4 and 8) by creating a single pronounced clicking positional-indicating noise each time the rotation of actuator top portion 11 in either direction moves clicking rib 70 past clicking post 54. FIG. 8 illustrates clicking rib 70 in solid line for the unlocked position of the actuator, and clicking rib 70 in dotted line for the locked position of the actuator. The bottom of clicking rib 70 extends below the top of clicking post 54 and clicking rib 70 rotationally aligns with clicking post 54 (see FIGS. 4 and 8). For the direction of rotation shown by the arrow in FIG. 8, clicking rib 70 will first encounter surface 54*a* of clicking post 54, bend and slide along surfaces 54*a* and 54*b*, and straighten to the dotted line position to create at the same time the positional click indication. When the direction of rotation is opposite that shown to the arrow of FIG. 8, clicking rib 70 (shown in dotted line) will first encounter surface 54*c* of clicking post 54, flex and slide along surfaces 54*c* and 54*d* of post 54, and straighten to the solid line position to create at the same time the positional click indication. In this above-described manner, it can be seen that a single clicking rib 70 and a single clicking post 54 serve to create a single click for each locking and unlocking of the actuator. The solid line and dotted line positions of clicking rib 70 in FIG. 8 are the unlocked and locked positions wherein the rib 70 is directly adjacent clicking post 54 when the above-described distinct and separate stops (63, 36 and 60, 35) have been encountered, and the angle of rotation of actuator upper portion 11 is therefore quite small between the unlocked and locked positions.

Turning now to remaining internal structure of actuator top portion 11, reference is made to cylinder 80 in FIGS. 3B and 4 centered on the actuator vertical axis and depending from the top wall of portion 11. Internal to cylinder 80 is depending pin 81 from said top wall, centered within cylinder 80 by four spokes 82. Upstanding cylinder 45 within lower actuator portion 12 (see FIG. 3A) extends up into and fits within cylinder 80 in top portion 11 (see FIG. 4) to assist in alignment and maintaining verticality of the upper and lower actuator portions 11 and 12 in assembly, rotation and dispensing operations.

Further referring to FIGS. 3B and 4, top actuator portion 11 has downwardly depending from its top wall a plurality of actuator spring biasing members 87, 88 and 89, each in the form of a cross-like member. Spring-biasing member 87 is comprised of intersecting radial rib 91 and curvilinear rib 94; spring-biasing member 88 is comprised of intersecting radial rib 90 and curvilinear rib 93; and spring-biasing member 89 is comprised of intersecting radial rib 92 and curvilinear rib 95. The intersecting radial and curvilinear ribs forming each of spring biasing members 87, 88 and 89, serve to provide structural stability to each spring biasing member. When the actuator top portion 11 is rotated to the actuating position against the afore-described stop defining that position, radial rib 90 and a portion of curvilinear rib 93 sit on top of plastic spring 50 and slightly bias spring 50 downwardly (see FIGS. 6 and 4, and 2 and 3B); radial rib 91 and a portion of curvilinear rib 94 sit on top of plastic spring 48 and slightly bias spring 48 downwardly; and, radial rib 92 and a portion of curvilinear 95 sit on top of plastic spring 49 and slightly bias spring 49 downwardly. Spring-biasing members 87, 88 and 89 are dimensioned in a downward direction with respect to plastic springs 48, 50 and 49 such that the plastic springs will be slightly depressed as described above over the whole range of aerosol valve stem heights. In this manner, the top portion 11 and bottom portion 12 of the actuator will not rattle against each other when actuation is not occurring, because of the assured contact between the plastic springs and the spring biasing members.

The spring-biasing members 87, 88 and 89, and the plastic springs 48, 50 and 49, also have a further distinct advantage. When the actuator top portion 11 in the actuating position is depressed as a unit vertically downward by the user, the aerosol valve stem is pressed downward to actuate the aerosol valve and dispense product in known fashion. When the user stops pressing upper portion 11 downward, the conventional metal spring in the aerosol valve itself will urge actuator portion 11 back upward, by urging the aerosol valve stem upwardly to in turn urge vertical product channel 41, cylinder 45 and thus actuator upward portion 11 upwardly. However, if the aerosol valve stem is a short stem extending into socket 42 of the actuator, the valve stem in the absence of the plastic springs 48, 50 and 49 may not push top actuator portion 11 back upwardly far enough to where actuator portion 11 is free to rotate from its unlocked position back to its locked position. In the presence of the plastic springs 48, 50 and 49, however, because they have been slightly depressed by spring-biasing elements 87, 88 and 89, the plastic springs will urge the spring biasing elements 87, 88 and 89 (and thus actuator portion 11) further upwardly so that portion 11 is free to rotate from the unlocked position back to the locked position of the actuator, even with a short aerosol valve stem height.

When actuator top portion 11 is in its locked position, spring-biasing elements 87, 88 and 89 will no longer sit upon and slightly depress springs 48, 50 and 49. This position is shown from underneath in FIG. 7. In the normal upright position of the actuator (FIG. 1), curvilinear ribs 94, 93 and 95 are each curved at their opposite ends upwardly toward the top of actuator portion 11 from which they depend, so that as the actuator top portion 11 is rotated (clockwise in FIG. 7) from its locked to its unlocked position (FIG. 6), the curved ends of the curvilinear ribs will begin to contact the tops of plastic springs 48, 50 and 49 and will cam the cross-like center of spring-biasing elements 87, 88 and 89 into contact with plastic springs 48, 50 and 49 to slightly depress said springs when the rotation to the unlocked actuating position is completed. The sides of plastic springs 48, 50 and 49 may be beveled to assist this camming.

It will be appreciated by persons skilled in the art that variations and/or modifications may be made to the present invention without departing from the spirit and scope of the invention. The present embodiments are, therefore, to be considered as illustrative and not restrictive. It should also be understood that positional terms as used in the specification are used and intended in relation to the positioning shown in the drawings, and are not otherwise intended to be restrictive.

What is claimed is:

1. An aerosol actuator for actuating an aerosol valve of an aerosol container, said actuator comprising in combination a top portion and a bottom portion, said bottom portion being mountable on the aerosol container, said top portion being mounted on said bottom portion, said top portion being rotatable with respect to said bottom portion between a first position for actuating the aerosol valve and a second position wherein the aerosol valve cannot be actuated; said top portion being a unitary member and in said first position being depressible as a whole in a vertical direction to actuate the aerosol valve; said bottom portion including an integral product channel connectable at one end to the aerosol valve and having a nozzle for expelling product at the other end; said top portion when vertically depressed acting to depress said product channel to actuate the aerosol valve; said product channel having a plurality of flexible laterally extending spring members associated therewith, and said top portion having a corresponding plurality of depending spring-biasing members that overlie, contact and slightly depress said plurality of spring members only when said top portion is rotated to said first position; said spring members urging said spring-biasing members and accordingly said top portion upwardly when said top portion is in said first position, including when said product channel member has returned to its non-depressed position following product dispensing.

2. The aerosol actuator of claim 1, wherein said top portion includes a downwardly depending cylinder, and said bottom portion includes an upwardly extending cylinder that fits within said downwardly depending cylinder to stabilize said top portion and assist in maintaining verticality upon actuation.

3. An aerosol actuator for actuating an aerosol valve of an aerosol container, said actuator comprising:

a bottom portion having an integral product channel connectable at one end to the aerosol valve and having a nozzle for expelling product at the other end, said bottom portion being mountable on the aerosol container;

a top portion mounted on said bottom portion for rotation with respect to said bottom portion about an axis of rotation between an actuating position and a non-actuating position, said top portion, when in said actuating position, being depressible along said axis of rotation to depress said integral product channel to actuate the aerosol valve, and said top portion, when in said non-actuating position, not being depressible to prevent actuation of the aerosol valve;

a plurality of first members laterally extending from said integral product channel; and a plurality of second members on said top portion, said plurality of second members overlying, contacting, and slightly flexing said plurality of first members when said top portion is rotated to said actuating position to urge said top portion upwardly.

4. The aerosol actuator of claim 3, wherein said bottom portion comprises an outer skirt secured to an internal ring member by a plurality of ribs so that an annular gap is defined between said outer skirt and said internal ring member and said top portion comprises a lower periphery with a plurality of spaced curved indentations which define peripheral segments, said top portion being mounted on said bottom portion so that said lower periphery is received in said annular gap.

5. The aerosol actuator of claim 4, wherein, when said top portion is in said actuating position, said plurality of indentations are aligned with said plurality of ribs so that said top portion can be depressed with respect to said bottom portion with said plurality of curved indentations moving downwardly over said plurality of ribs with said peripheral segments lying between said plurality of ribs.

6. The aerosol actuator of claim 4, wherein, when said top portion is in said non-actuating position, said peripheral segments are aligned with and sit on top of said plurality of ribs so that said top portion cannot be depressed with respect to said bottom portion.

7. The aerosol actuator of claim 4, wherein said internal ring has an inside edge and said top portion has a plurality of a downwardly extending flexible connecting flanges with an outwardly and upwardly directed rib adjacent said lower end of each such connecting flange, said upwardly directed ribs extending under said inside edge of said internal ring to connect said top and bottom portions.

8. The aerosol actuator of claim 7, wherein said downwardly extending connecting flanges are attached to said top portion by a plurality of supporting flanges, one supporting flange of each connecting flange also serving as a stop member; said bottom portion having a pair of upstanding vertical wing flanges that also serve as stop members; and certain of said stop members of said top and bottom portions acting to terminate rotation of said top portion at said actuating and non-actuating positions.

9. The aerosol actuator of claim 7, further comprising:

a clicking post on one of said bottom portion and said top portion; and a flexible clicking rib on the other of said bottom portion and said top portion, wherein said clicking post has a first surface for engaging and deflecting said flexible clicking rib towards said axis of rotation in one direction of rotation of said top portion and a second surface for engaging and deflecting said flexible clicking rib away from said axis of rotation in an opposite direction of rotation of said top portion.

10. The aerosol actuator of claim 3, wherein said top portion includes a downwardly depending cylinder, and said bottom portion includes an upwardly extending cylinder that fits within said downwardly depending cylinder to stabilize said top portion and assist in maintaining verticality upon actuation.

11. The aerosol actuator of claim 3, further comprising:

a clicking post on one of said bottom portion and said top portion; and a flexible clicking rib on the other of said bottom portion and said top portion, wherein said clicking post has a first surface for engaging and deflecting said flexible clicking rib towards said axis of rotation in one direction of rotation of said top portion and a second surface for engaging and deflecting said flexible clicking rib away from said axis of rotation in an opposite direction of rotation of said top portion.

* * * * *